United States Patent [19]

Keritsis

[11] Patent Number: 4,589,428

[45] Date of Patent: May 20, 1986

[54] TOBACCO TREATMENT

[75] Inventor: Gus D. Keritsis, Richmond, Va.

[73] Assignee: Philip Morris Incorporated, New York, N.Y.

[21] Appl. No.: 123,247

[22] Filed: Feb. 21, 1980

[51] Int. Cl.[4] ..... A24B 15/24; A24B 15/30

[52] U.S. Cl. ..... 131/297; 131/352; 131/353; 131/358; 131/359

[58] Field of Search ..... 131/140 C, 140 P, 140 Z, 131/17, 15 C, 140 B, 140 R, 143, 297, 298, 369, 370, 352, 353, 354, 358

[56] References Cited

U.S. PATENT DOCUMENTS

| | | | |
|---|---|---|---|
| 467,055 | 1/1892 | Scheider | 131/17 R |
| 2,029,494 | 2/1936 | Loewenthal | 131/140 R |
| 2,122,421 | 7/1938 | Hawkinson | 131/140 R |
| 2,776,916 | 1/1957 | Ericsson | 131/17 R |
| 2,914,072 | 11/1959 | Tyrer | 131/140 R |
| 3,126,011 | 3/1964 | Haden | 131/17 R |
| 3,616,801 | 11/1971 | Hind | 131/143 |
| 3,847,164 | 11/1974 | Mattina et al. | 131/143 |
| 4,131,117 | 12/1978 | Kite et al. | 131/140 C |
| 4,131,118 | 12/1978 | Gellatly et al. | 131/140 C |

FOREIGN PATENT DOCUMENTS

| | | | |
|---|---|---|---|
| 2632693 | 2/1978 | Fed. Rep. of Germany | 131/140 B |

*Primary Examiner*—V. Millin

*Attorney, Agent, or Firm*—Jeffrey H. Ingerman

[57] ABSTRACT

A process for maximizing reduction of gas phase components during combustion of tobacco products is disclosed. The process comprises contacting tobacco material with an aqueous solution to form a tobacco extract. After separating the extract from the fibrous tobacco portion, the extract is treated to remove potassium nitrate by ion exchange, electrodialysis, crystallization techniques or the like. Thereafter, potassium ions in the form of a potassium salt other than potassium nitrate are restored to the potassium depleted tobacco and/or extract to a level approximating that originally present in the tobacco prior to extractions.

9 Claims, No Drawings

TOBACCO TREATMENT

BACKGROUND OF THE INVENTION

1. Field of the Invention

This invention relates to a method for maximizing reduction of delivery of nitrogen oxides, HCN and CO in tobacco smoke. In accordance with the invention, tobacco materials are contacted with an aqueous solution to form a tobacco extract. The extract is treated to remove potassium nitrate. Thereafter potassium ions are restored to the tobacco extract to a level approximating that originally present in the unextracted tobacco. By restoring potassium ions to the denitrated extract, a greater reduction in delivery of gas phase constituents is achieved relative to the amount of nitrate removed, than if the potassium ions are not restored to the tobacco materials. In addition, greater reduction in HCN and CO is observed.

2. Description of the Prior Art

Tobacco contains a number of nitrogen containing substances which during the burning of the tobacco yield various components in the smoke. Removal of some of these smoke components, such as the oxides of nitrogen, is considered desirable.

Nitrate salts, such as potassium, calcium and magnesium nitrates, are a major class of nitrogenous substances which are precursors for nitrogen oxides, especially nitric oxide. These nitrate salts are normally found in great abundance in burley tobacco stems and strip, in flue-cured tobacco stems to a lesser degree, and in reconstituted tobaccos which utilize these components. Attempts have been made to reduce or remove the nitrate from these tobaccos to bring about a significant reduction in the oxides of nitrogen delivered in their smoke. Among the techniques which have been employed to this end are extraction methods whereby the nitrates are removed from the tobacco material.

In accordance with extraction techniques, tobacco materials are generally contacted with water. In this manner an extract containing the tobacco solubles including the nitrates is formed. The extract is collected and may be discarded or may be treated to remove the nitrates. The denitrated extract may thereupon be reapplied to the fibrous insoluble tobacco material from which it was originally removed.

Although extract treatment methods seek to minimize the removal of materials other than nitrates from the tobacco and thereby avoid affecting the subjective characteristics of the tobacco or its filling capacity, burn qualities and the like, other materials are in fact removed by such methods. For example, the nitrates are commonly removed as potassium salts. Specifically, U.S. Pat. Nos. 4,131,118 and 4,131,117 describe a denitration process wherein potassium nitrate is crystallized from an aqueous tobacco extract followed by reapplication of the denitrated extract to the tobacco. In U.S. Pat. No. 3,847,164 denitration is effected by means of ion-retardation resins which retard ionic material, specifically potassium nitrate, in tobacco extracts, while non-ionic constituents pass unaffected. Thus, these methods remove not only nitrate ions, but also potassium ions.

In addition to denitration, extraction processes are employed where removal of other tobacco components is desired. For example, U.S. Pat. No. 3,616,801 describes a process for improving the tobacco burn properties, smoke flavor and ash by controlling the ion content of the tobacco. In accordance with the process therein disclosed the proportion of metallic ions in an aqueous tobacco extract is adjusted, followed by reapplication of the treated extract to the tobacco. Among the treatments suggested for adjusting the metal ion content are ion exchange and membrane electrodialysis. Removal of potassium ions and their replacement with ammonium, hydrogen, calcium or magnesium ions are particularly desirable in the practice of this process. Levels of other ions including nitrate may also be adjusted to alter the tobacco properties. In Example 6, over 50% of both nitrate and potassium ions were removed by means of electrodialysis.

The addition of potassium salts to conventional, unextracted tobacco materials has been suggested for a variety of reasons. For example, in German Offenlegungsschrift No. 2,632,693, $KNaCO_3.6H_2O$, $K_2CO_3$ and glycols may be added to tobacco stems to a pH of 8–9 and thereafter the stems are mixed with leaf filler. This tobacco stem treatment is said to decrease the smoke content of aldehydes and condensate. Potassium phosphates are disclosed as having humectant properties when added to tobacco at a level of at least 0.5% by weight, according to U.S. Pat. No. 2,776,916. U.S. Pat. No. 467,055 discloses a process for improving the burning qualities of poor grade tobaccos by applying thereto potassium carbonate. The treatment is also said to render the tobacco decay proof.

In U.S. Pat. No. 2,972,557 smoking tobacco is treated with an alkali metal compound such as sodium bicarbonate, potassium bicarbonate or potassium ruthenate at an approximate level of 2 to 8% to produce a smoking product which burns below a temperature of 800° F. According to the inventor, the temperature control substances reduce the amount of compounds that may be volatilized and released into the smoke.

In U.S. Pat. No. 3,126,011 there is disclosed a process for reducing high-molecular weight compounds resulting from pyrolysis of tobacco materials. Incombustible solids capable of melting endothermically at a temperature at or below the burning temperature of the tobacco are suggested and include salts of borates, phosphates and silicates, and hydrates thereof with cations selected from potassium, lithium, and sodium. The salts are applied to tobacco at a level between about 3 and 10% by weight.

In U.S. Pat. No. 2,914,072 there is described a process for upgrading poor quality tobacco and particularly tobacco having increased alkalinity of the smoke. According to the inventor, primary and secondary catalyst in combination with aliphatic acids promote a greater degree of thermal destruction of nitrogen bases thereby reducing alkalinity of the smoke. Salts of cobalt, manganese, nickel, copper, chromium and silver comprise primary catalyst while salts of potassium, magnesium, barium and sodium comprise secondary catalyst. Application to tobacco of about 2% of each class of salts apparently produce satisfactory results.

In some instances tobacco is extensively extracted and the resultant extract discarded. No attempt is made to selectively remove certain constituents of the extract and then return the extract to the fibrous tobacco residue. For example, in U.S. Pat. No. 2,122,421, tobacco leaf ultimately used for cigar wrappers is subjected to a "steeping or scrubbing" action followed by further extraction in an aqueous-alkaline bath generally at a pH between 8 to 11. According to the inventor, the burning qualities of the tobacco are usually completely destroyed by the above-described treatment. In order to restore burn properties, a salt such as potassium acetate is added to the depleted fibrous tobacco residue by immersing the residue in an aqueous bath containing approximately 12.5 pounds potassium acetate per gallon of solution.

In accordance with U.S. Pat. No. 2,029,494, tobacco leaf is subjected to extraction in a nitric acid-containing bath whereby substantially all of the naturally occurring gums, oils, nicotine and mineral matter including salts are removed. The "skeleton leaf" consisting essentially of the woody and starch components is then treated to impart the desired color, flavor, aroma, ash and smoking properties. A solution containing equal portions of a tobacco extract derived from tobacco stems; a mineral mixture containing potassium acetate, potassium nitrate and calcium acetate; and a third solution containing potassium carbonate, is prepared and applied to the previously extracted tobacco leaf. The thus treated leaf is then used as a cigar wrapper.

It is generally recognized that discarding tobacco extracts results in the loss of valuable tobacco solubles, many of which contribute substantially to the subjective characteristics of the tobacco. The process of the present invention is advantageous in that tobacco is subjected to aqueous extraction and the resultant extract is denitrated whereby potassium nitrate is predominantly removed while maintaining other desirable tobacco solubles intact. Thereafter potassium ions are restored to the potassium-depleted tobacco to a level approximating that originally present prior to extraction.

A proportionately greater reduction in delivery of nitrogen oxides in tobacco smoke relative to degree of nitrate removal is achieved than when the potassium ions are not restored.

SUMMARY OF THE INVENTION

The present invention provides a method for treating tobacco whereby a reduction of various gas phase components of tobacco smoke is achieved. Specifically, reduced NO, HCN and CO deliveries by tobacco smoke are effected. Moreover, the relative reduction of nitrogen oxide delivery by tobacco products during combustion is maximized.

In accordance with the present invention, tobacco materials are contacted with an aqueous solution to obtain an aqueous extract and an insoluble fibrous tobacco portion. The extract and the insoluble fibrous materials are separated whereupon the extract is treated to remove potassium nitrate. A potassium salt such as the citrate, acetate, malate, carbonate, bicarbonate or phosphate is restored to the thus treated potassium depleted extract to a level approximating the potassium ion content originally present in the tobacco. The potassium enriched extract is then applied to the insoluble fibrous tobacco portion. Alternatively, potassium ions in the form of potassium salts may be restored to the fibrous tobacco portion or may be incorporated at any stage of conventional tobacco processing. Smoking tobacco products containing tobacco which has been treated in this manner produce relatively less nitric oxide than products in which the potassium ions have not been restored.

DETAILED DESCRIPTION OF THE INVENTION

In accordance with the present invention tobacco is denitrated in a manner which enhances the relative reduction in delivery of oxides of nitrogen and reduces the delivery of HCN and CO. This is accomplished by removal of potassium nitrate salts followed by restoration of potassium ions in the form of salts other than potassium nitrate. By restoring the potassium ions to approximately the original level, a greater reduction in nitrogen oxide delivery, particularly nitric oxide, is achieved relative to the amount of nitrate removed, than when potassium is not restored.

In the practice of the process, the tobacco material is typically contacted with an aqueous solution in order to extract the soluble components, including potassium and nitrate salts. The aqueous solution employed may be water or preferably a denitrated aqueous extract of tobacco containing tobacco solubles. The extraction can be effected using 5:1 to 100:1 aqueous solution to tobacco ratio (w/w) at 20°–100° C., preferably 60°–95° C., for a period of time ranging from a few seconds to several minutes or longer, depending on the particular temperature and volume of water or solubles used. In order to maximize the extraction of nitrate, the wetted tobacco is generally pressed, centrifuged or filtered at the end of the extraction time whereby the excess water and residual nitrate that may be present on the tobacco surface and in suspension are removed. By employing this mode of operation the need for excessive drying of the tobacco to remove the excess moisture can be avoided.

The aqueous tobacco extract is then treated to remove the potassium nitrate contained therein while preferably minimizing the loss of other tobacco solubles. The potassium nitrate may be removed by processes disclosed in U.S. Pat. Nos. 4,131,117 and 4,131,118 wherein the tobacco extract is concentrated in vacuo to a total solids content of about 30% to 70% and a nitrate-nitrogen content of about 1% to 3%. The concentrated extract is then fed into a refrigerated centrifuge to effect crystallization of the potassium nitrate. The crystalline salt is separated from the extract by filtration, centrifugation or the like.

In accordance with the invention, potassium in the form of a salt, such as, for example, the citrate, acetate, malate, carbonate, bicarbonate or phosphate, is added to the denitrated tobacco extract, the fibrous portion or both in an amount sufficient to restore the potassium essentially to its original level prior to extraction. The salt is preferably added as an aqueous spray but may be applied in any manner in which an even distribution on the tobacco is obtained. The potassium salt may be added after extraction and before drying, or it may be incorporated in casing solutions and applied to the tobacco at any stage during conventional processing. The restoration of potassium ions to the extracted tobacco results in reduced levels of oxides of nitrogen, carbon monoxide and HCN when compared to extracted tobacco that has not been treated to restore the potassium ions.

The amount of potassium salts present in tobacco will vary depending on the type of tobacco being treated. For example, burley tobaccos generally will have a higher content of potassium salts than bright tobacco. Crop variation due to seasonal factors may also influence the amount of potassium salts present in tobacco.

In order to determine the amount of potassium ions lost during denitration wherein potassium nitrate is predominantly removed, it is only necessary to measure the potassium level prior to and after denitration of the tobacco. Potassium determinations may be made by extracting a small sample of tobacco with dilute acid and analyzing an aliquot of the extract by conventional atomic absorption spectrophotometry. Details of the procedure used for measuring potassium levels may be found in *Analytical Methods of Analysis by Atomic Absorption Spectrophotometry* published by Perkin Elmer, September 1976.

In certain instances, a partially denitrated tobacco extract prepared according to the process previously described in U.S. Pat. Nos. 4,131,117 and 4,131,118, the contents of which are incorporated herein by reference, may be further denitrated, for example, by ionic membrane electrodialysis. Alternatively, the tobacco extract may be denitrated by electrodialysis without prior treatment via the crystallization process.

In a preferred method for effecting denitration, a tobacco extract whether partially denitrated or not is adjusted to a solids content of about 5–50% and a resistivity of about 8–50 ohm-cm and is then rapidly circulated through the alternate cells of an electrodialysis unit. The unit comprises an anion permeable membrane toward the anode spaced no more than about 0.04 inches from an anion impermeable membrane toward the cathode. Brine is circulated in the remaining cells and voltage of about 0.5 to about 2.0 volts/cell pair is applied thereby selectively extracting the nitrate salts into the brine cells, without substantial removal of other tobacco solubles.

The anions present in the tobacco extract cells, specifically the nitrate ions, migrate toward the anode upon imposition of an electric potential. The brine cells into which the nitrate ions migrate have an anion impermeable membrane toward the anode; therefore, the nitrate ions remain and are concentrated in the brine cells and can thus be removed from the system. Potassium ions migrate in a similar manner toward the cathode upon imposition of an electrical potential.

The electrodes employed in the electrodialysis unit may be carbon, stainless steel, platinum, or other type of non-corrosive conductive material that does not react with the electrolyte and does not introduce metallic ions in solution, especially polyvalent ions such as $Cu^{++}$ and $Al^{+++}$, that may react with the ionic membrane or with the tobacco solubles and cause membrane fouling and/or scaling on the membrane surface. Preferably hastelloy carbon cathode plates and platinized columbium anode plates are employed.

The solutions in the electrode cells may be different for the anode and the cathode, but preferably are the same. These electrolyte solutions should comprise an approximately 0.1N solution of an alkali metal salt, preferably a potassium salt of an anion that will not react and will create minimum gas at the electrodes or of an anion that will not foul the membranes nor precipitate polyvalent cations such as $Ca^{++}$, $Mg^{++}$, $Al^{+++}$, and the like on the surface of the membrane. In this connection, regard should be given to the pH that is being used. Electrolytes that are particularly preferred are those containing potassium acetate or sulfate and having a pH of about 2–5.

The membranes employed to isolate the electrodes may be of the same nature and thickness as those used in the overall stack. However, these membranes are preferably thicker, more ionic and tighter (less porous). Also, the spacers that are placed between the electrodes and the anode-cathode membranes may be of the same thickness as those used in the overall stack, but preferably they should be thicker, i.e., about twice the thickness of the remaining spacers to allow a greater circulation ratio of electrolyte on the surface of the electrodes.

The brine solution will typically be aqueous. It is preferable that a small concentration of ionic material be present in the brine during the initial phase of operation in order to create some conductivity. Thus, for example, the brine may initially be seeded to 0.1 weight percent potassium or sodium nitrate, chloride or acetate, or nitric, hydrochloric, or acetic acid or with potassium or sodium hydroxide.

The anion permeable membranes may be neutral or ionic membranes having a positive fixed electrical charge. Positively charged membranes which will attract and pass anions and repel cations are anion permeable. Cation permeable membranes are negatively charged and will attract and pass cations and repel anions. Neutral membranes will allow either anions or cations to pass through when a voltage is applied across the ionic solution that is confined between such membranes. The use of electrodialysis will be described in greater detail in the examples hereinbelow.

When very dilute streams are to be deionized and to reduce membrane fouling and energy requirements, that is, avoid electrolysis, the efficiency of the process is enhanced in a system using ion exchange resins and membrane electrodialysis. In electro-regenerated ion exchange deionization, the setup is the same as membrane electrodialysis except for the addition of a mixed bed of weak ion exchange or ionic resins to each cell through which the tobacco solubles are to be passed. The dilute solution of ions to be deionized enters the cells that contain the mixed bed of resins. The ions are "trapped" or picked up by the resins causing an increase in ionic concentration and electroconductivity between the electrodes of the electrodialysis cell and thus a lesser amount of electrical power is required. The applied electrical potential causes the anions to transfer through their respective membranes into the brine cells where they are concentrated and removed. The mixed bed of the weak ion exchange resins is continuously regenerated without interruption and without the use of high amounts of additional chemicals or additional power as is the case with standard ion exchangers. The mixed bed of weak ion exchange resins may be composed of a single resin having both negative and positive groups, two different resins, one anionic and one cationic, in bed or "spacer" type form. The spacer form may be in a basket or wire cloth type weave or in film form (similar to bipolar membranes) specially manifolded to allow flow.

Another method of removing potassium nitrate in accordance with the invention entails the use of ion exchange or ion retardation techniques. The tobacco extract in either dilute or concentrated form is passed over a mixed bed of anion and cation exchange resins whereby the potassium nitrate is removed. In a typical run, the tobacco extract having a solids concentration of 3% to 30% is passed over a mixed bed or column of anion/cation exchange resins such as Rexyn 101 (H) which is a sulfonated polystyrene-divinyl benzene copolymer having $RSO_3^-$ active groups (cation exchange) and Rexyn 201 (OH) which is a polystyrene-divinyl benzene alkyl quaternary amine having $R_4N^+$ active group (anion exchange).

Denitration may also be effected by means of Donnan dialysis. In employing this method a cationic membrane (positively charged, anion permeable) is utilized to separate the tobacco extract from the stripping solution. The stripping solution will be a preferably strong base, such as sodium or potassium hydroxide at a pH of 7.5 to 9.5. The time required to denitrate the tobacco extract depends on the membrane surface, the thickness of the membrane and the tobacco extract compartment as well as the nitrate concentration and temperature used. Materials such as metaphosphates may be added to the tobacco extract or stripping media to maintain polyvalent metal ions in solution and prevent their precipitation on the membrane surface.

In order to further minimize loss of solubles other than nitrate salts, extraction of the tobacco material may be effected with denitrated tobacco extracts. By means of this expedient it is possible to reduce the amount of non-nitrate materials removed from the tobacco since after several extractions the extract liquor will approach saturation. Thus, except for the nitrates, reduced amounts of materials will be removed during subsequent extraction steps. This is a preferred mode of operation for treating tobacco strip or reconstituted tobacco.

Following denitration of the tobacco extract, the extract is recombined with the insoluble tobacco material from which it was removed. At this point, a determination of potassium ions lost during extraction is made by conventional methods previously described. Potassium restoration is accomplished by adding to the denitrated extract or fibrous tobacco portion a suitable potassium salt such as the citrate, acetate, malate, carbonate, bicarbonate or phosphate, generally in an aqueous solution. The restoration may be carried out by spraying, dipping and the like. In some instances, it may be desirable to incorporate the potassium salt at a later stage of processing. To this effect, the potassium salt may be added to the casing solutions or at any other processing stage where application of additives such as for example, the addition of humectant occurs. Prior to reapplication the extract may be concentrated if necessary or desired. The reapplication may be effected by any suitable means such as spraying, coating, dipping or slurry processes. The tobacco may then be dried or otherwise processed to put it in condition for use in tobacco products. Thereupon treated tobacco may be used in any smoking tobacco product desired. The tobacco products will exhibit reduced delivery of nitrogen oxides, HCN and CO during combustion. Further, the ratio of nitrogen oxide reduction to nitrate removed for products formed from tobacco treated in accordance with the invention is greater than that for products containing tobacco which has not been selectively denitrated.

It is to be understood that the process of the invention may be employed with whole cured tobacco leaf, cut or chopped tobacco, tobacco filler, reconstituted tobacco, tobacco stems and the like. As used herein, references to tobacco and tobacco materials include all such forms of tobacco. Further it is to be understood that the tobacco treated in accordance with the invention reduces nitrogen oxide delivery in any tobacco product which is consumed by combustion and that references to smoking tobacco products include cigars, cigarettes, cigarillos, pipe tobacco and the like.

The following examples are illustrative:

EXAMPLE 1

Burley tobacco was extracted with water and portions of the extract were subjected to ion exchange treatments. One portion was treated with Fisher Scientific Rexyn 201 (OH) anion exchange resin, which is a polystyrene-divinyl benzene alkyl quaternary amine having $R_4N^+$ active groups, to selectively remove nitrate ions without removing potassium ions. A second portion of the tobacco solubles was treated with a mixed bed of exchange resins composed of the above Fisher Scientific Rexyn 201 (OH) resin and a Fisher Scientific Rexyn 101 (H) cation exchange resin, which is a sulfonated polystyrene-divinyl benzene copolymer having $RSO_3^-$ active groups, to effect removal of both potassium and nitrate ions. The composition of the extract and the gas phase delivery of the tobacco upon recombination with the extracts were analyzed. Similar analyses were conducted on unextracted burley tobacco, burley tobacco extracted with water and burley tobacco extracted with water and cased with potassium citrate.

Corresponding analyses were performed on a tobacco blend composed of burley, bright, Oriental and reconstituted tobaccos wherein the burley and reconstituted tobacco portions were subjected to the various extraction and/or casing treatments.

The results are set forth in Table 1.

TABLE 1

| Cigarette Filler | | | | Gas Phase in Cigarette Smoke by GC mg/puff | | | |
|---|---|---|---|---|---|---|---|
| Type | Treatment | % $NO_3$—N | % K | NO × $10^{-2}$ | HCN × $10^{-2}$ | CO | P.C. No. Puffs/Cigt. |
| Burley | Control | 0.44 | 4.10 | 5.4 | 1.6 | 1.9 | 9 |
| Burley | Extracted with $H_2O$ | 0.21 | 2.32 | 3.9 | 1.3 | 1.9 | 10 |
| Burley | Extracted + $K_3$-Citrate | 0.20 | 3.35 | 2.8 | 0.8 | 1.7 | 10 |
| Burley | Anion-Exchanged | 0.20 | 3.96 | 2.3 | 0.4 | 1.2 | 10 |
| Burley | Anion/Cation-Exchanged | 0.20 | 2.65 | 2.9 | 0.9 | 1.5 | 11 |
| Blend | Control | 0.23 | 3.67 | 3.1 | 2.0 | 1.9 | 8 |
| Blend | Extracted with $H_2O$ | 0.06 | 1.83 | 1.7 | 2.4 | 2.0 | 9 |
| Blend | Anion/Cation-Exchanged | 0.06 | 1.85 | 1.4 | 2.4 | 1.8 | 11 |
| Blend | Anion-Exchanged | 0.07 | 3.69 | 1.2 | 1.2 | 1.6 | 9 |
| Blend | Cation-Exchanged | 0.22 | 3.09 | 2.9 | 3.0 | 2.2 | 9 |

EXAMPLE 2

Tobacco was pulped with water and the extract containing the solubles was separated and concentrated. The extract was partially denitrated in accordance with the crystallization methods of U.S. Pat. Nos. 4,131,117 and 4,131,118. A portion of the resulting extract was thereupon further denitrated by electrodialysis employing a 20 cell pair unit. The membranes were 9"×10" with an effective membrane area of 5.0 $ft^2$. The cells comprised Ionics' 61CZL 386 cation permeable paired with 103QZL 386 anion permeable membranes. These anion permeable membranes are about 0.63 mm thick, contain about 36 weight percent water and comprise crosslinked copolymers of vinyl monomers and contain quarternary ammonium anion exchange groups and are homogeneously film cast in sheet form on a reinforcing synthetic fabric composed of modacrylic polymer. The cation permeable membranes are about 0.6 mm thick, contain about 40 weight percent water and comprise crosslinked sulfonated copolymers of vinyl compounds which are also homogeneously film cast in sheet form on synthetic reinforcing fabrics. The spacers were 0.04". The membranes in front of the electrodes were Ionics' 61AZL-389 which were separated from the platinum-niobium, stainless steel electrodes by 0.08" thick spacers. The brine solutions were 0.1% aqueous $KNO_3$ solutions, and the electrolytes were 0.1N $K_2SO_4$ and $H_2SO_4$ having a pH adjusted to 2 to 4. The electrodialysis was effected by application of 30 volts. The temperature of the solubles during the runs were not controlled and varied between about 88°-98° C. The pH at 22° C. was about 4.75.

Half of the resulting denitrated extract was thereupon reapplied to a portion of the tobacco web formed from the extracted pulp and used to form sample cigarettes. A second sample was prepared by adding potassium acetate to the remaining electrodialyzed solubles prior to reapplication to the web. The control sample comprised web treated with the partially denitrated extract.

The results of analyses of these samples is set forth in Table 2.

TABLE 2

EFFECT OF DENITRATION OF RECONSTITUTED TOBACCO ON GAS PHASE IN SMOKE

| Cigarette Filler | | | Gas Phase Analysis by GC of Cigarette Smoke mg/puff | | | |
|---|---|---|---|---|---|---|
| Type | % $NO_3$—N | % $K^+$ | NO × $10^{-2}$ | HCN × $10^{-2}$ | CO | P.C. No. Puffs/Cigt. |
| Reconstituted Tobacco | 0.35 | 4.3 | 3.6 | 2.3 | 2.63 | 8 |
| Denitrated Reconstituted Tobacco | 0.06 | 2.6 | 1.6 | 4.6 | 2.80 | 10 |
| Denitrated reconstituted Tobacco (with potassium acetate) | 0.05 | 3.6 | 0.9 | 2.1 | 2.20 | 10 |

EXAMPLE 3

Three kg of burley strip was extracted with 26 liters of water at 80° C. The tobacco was dipped in the water bath for a contact time of 1 minute. The extracted tobacco was dried, equilibrated, shredded, and made into cigarettes having conventional cellulose acetate filters attached thereto. Unextracted tobacco was also shredded and used for control cigarettes. A second batch of identical burley strip was extracted in the same manner and then dried and equilibrated. Potassium content of the extracted tobacco was measured and potassium citrate was applied to the dried tobacco to a level approximating that originally present.

Cigarettes containing 100% of the extracted; extracted and cased; and untreated burley tobacco, as well as about 30% of each sample in admixture with a typical blend of tobaccos, were smoked under controlled laboratory conditions. The total particulate matter (TPM) and gas phase constituents were analyzed to determine delivery rates. The nitrate-nitrogen content of the treated and untreated tobaccos was determined using a Technicon Autoanalyzer II system with a modification of the procedure as published by L. F. Kamphake et al., *International Journal of Air and Water Pollution,* Volume 1, pages 205-216, 1976. The results are tabulated in Table 3 below.

TABLE 3

ANALYTICAL DATA

| | Filler | | | Smoking Results | | | | | |
|---|---|---|---|---|---|---|---|---|---|
| | Percent $NO_3$—N | Percent K | Percent $NO_3$—N Reduction | FTC Tar, mg/ Cigarette | CO, mg/ Cigarette | HCN, mg/ Cigarette | NO, mg/ Cigarette | P.C., Puffs, Cigarette | Percent NO Reduction |
| 100% Burley Control | 0.43 | 3.40 | — | 14.9 | 14 | 0.16 | 0.41 | 9 | — |
| 100% Extracted Burley | 0.13 | 1.67 | 70 | 19.2 | 19 | 0.20 | 0.27 | 9 | 34.2 |
| 100% Extracted/Cased with Potassium Citrate | 0.12 | 3.01 | 72 | 15.4 | 15 | 0.13 | 0.18 | 9 | 56.1 |
| Blend with Control Burley | 0.33 | 3.76 | — | 14.6 | 15 | 0.14 | 0.30 | 9 | — |
| Blend with Extracted Burley | 0.23 | 2.93 | 30.3 | 15.8 | 16 | 0.17 | 0.29 | 9 | 3.3 |
| Blend with Extracted/Cased with Potassium Citrate | 0.19 | 3.38 | 42.4 | 15.5 | 15 | 0.14 | 0.22 | 9 | 26.7 |

The data indicate that improved reductions are achieved in such gas phase smoke components as NO, HCN and to a lesser extent CO, when potassium is restored to tobaccos which have been treated to remove potassium nitrate. The data also indicate that potassium restoration does not alter the puff count.

EXAMPLE 4

Step A

Using the general procedure as disclosed in U.S. Pat. No. 4,131,118, a blend of tobaccos containing approximately 30% by weight of burley tobacco stems was extracted with water. The aqueous tobacco extract was separated from the fibrous tobacco materials and concentrated in vacuo to about 45% soluble solids. The concentrated tobacco extract was then conveyed to a chilled crystallizer unit maintained at a temperature of about 10° to 15° F. The potassium nitrate crystalline material that formed was separated by centrifugation, and an aliquot of the denitrated extract was reapplied to the previously extracted tobacco material, which had been cast into sheet form. This reconstituted tobacco sheet was labeled Sheet A. Portions of Sheet A were cased with a solution of potassium citrate and labeled $A_1$ through $A_3$. Cigarettes containing 100% of the thus prepared sheets were made and smoked automatically. The gas phase constituents were measured on a puff-by-puff basis using conventional techniques. The smoking data is tabulated in Table 4 below.

Step B

An aliquot of the denitrated extract as prepared in Step A was extensively denitrated using ionic membrane electrodialysis procedures basically as described in Example 2. This extract was then reapplied to the previously extracted fibrous tobacco material to produce a reconstituted tobacco sheet labeled B. Portions of this sheet were cased with a solution of potassium citrate and were labeled $B_1$ and $B_2$ respectively. Cigarettes were made from the thus prepared sheets and were smoked mechanically as in Step A. The control cigarette as prepared in Step A was also smoked for comparison purposes. The smoking data is tabulated in Table 4.

Step C

An aliquot of the extracted fibrous tobacco material obtained in Step A was cast into a sheet of tobacco and labeled Sheet C. The tobacco solubles were not reapplied to the sheet. Portions of Sheet C were cased with a solution of potassium citrate, dried, and then made into cigarettes labeled $C_1$ through $C_3$. The cigarettes, including a control labeled C, were smoked, and the gas phase was analyzed as in Step A. The results are tabulated in Table 4.

TABLE 4

| Cigarette Code | SMOKING DATA: Gas Phase Constituents in mg/puff HCN | RCHO | CO | NO | Puff Count | % Based on Weight of Sheet $K^+$ | $NO_3$—N | Total N |
|---|---|---|---|---|---|---|---|---|
| A | 0.021 | 0.090 | 2.33 | 0.037 | 10 | 4.86 | 0.32 | 3.35 |
| $A_1$ | 0.018 | 0.099 | 2.75 | 0.038 | — | 4.70 | 0.32 | 3.33 |
| $A_2$ | 0.015 | 0.101 | 2.75 | 0.038 | — | 5.29 | 0.31 | 3.21 |
| $A_3$ | 0.010 | 0.094 | 2.00 | 0.027 | — | 5.74 | 0.30 | 3.12 |
| A | 0.018 | 0.082 | 2.30 | 0.050 | — | 4.72 | 0.37 | 4.02 |
| B | 0.010 | 0.080 | 1.82 | 0.011 | 11 | 4.28 | 0.07 | 2.97 |
| $B_1$ | 0.006 | 0.070 | 1.23 | 0.008 | 13 | 5.77 | 0.06 | 2.90 |
| $B_2$ | 0.004 | 0.050 | 1.23 | 0.006 | 13 | 7.63 | 0.06 | 2.77 |
| C | 0.013 | 0.114 | 3.00 | 0.013 | — | 0.75 | trace | 1.32 |
| $C_1$ | 0.007 | 0.116 | 2.80 | 0.008 | — | 2.47 | trace | 1.31 |
| $C_2$ | 0.003 | 0.103 | 2.70 | 0.004 | — | 3.97 | trace | 1.20 |
| $C_3$ | 0.004 | 0.110 | 2.40 | 0.006 | — | 4.33 | trace | 1.18 |

EXAMPLE 5

Thirty parts of burley strip tobacco were extracted with 450 parts of water at 90° C. The fibrous tobacco portion was separated from the aqueous portion by centrifugation and air dried at room temperature.

The aqueous extract was treated with a mixed anion-cation exchange resin [Fisher Scientific Rexyn 201 (OH) and Rexyn 101 (H)] to remove both potassium and nitrate ions. Thereafter the denitrated extract was concentrated to a solids content of approximately 15%.

The concentrated extract was divided into three equal weight portions and reapplied to equal weight portions of the fibrous tobacco residue to produce three sheets of reconstituted tobacco in the following manner:

Sheet A: Extract plus residue;

Sheet B: Extract plus residue plus potassium citrate in an amount sufficient to give a 2% by weight restoration of potassium to the final sheet;

Sheet C: Same as B except that the restoration of potassium in the form of potassium citrate was 4% by weight.

The above prepared reconstituted tobacco sheets were shredded and cigarettes were made and smoked mechanically. An untreated burley strip sample was also made into cigarettes and used as the control. The gas phase was trapped and analyzed. The results are tabulated in Table 5 below.

TABLE 5

| Sample | % $NO_3$—N DWB* | % $K^+$ DWB | NO mg/cigt. | CO mg/cigt. | HCN mg/cigt. | Puff Count |
|---|---|---|---|---|---|---|
| Control | 0.57 | 4.5 | 0.67 | 14 | 0.17 | 10.8 |
| Sheet A | 0.05 | 1.6 | 0.19 | 15 | 0.16 | 13.1 |
| Sheet B | 0.05 | 3.5 | 0.10 | 14 | 0.09 | 11.8 |
| Sheet C | 0.05 | 4.9 | 0.08 | 12 | 0.06 | 12.5 |

*Dry weight basis

I claim:

1. In the preparation of a smoking tobacco product including the steps of forming an aqueous extract of tobacco, separating the aqueous extract from the fibrous tobacco residue, the improved method of treating the tobacco to obtain a product which exhibits reduced delivery of gas phase components during combustion thereof, which methhod comprises subjecting tobacco to the following treatments:

(a) measuring the potassium content of the aqueous extract;

(b) treating the aqueous extract to remove potassium nitrate therefrom;

(c) remeasuring the potassium content of the denitrated extract obtained in step (b) and thereafter adding a potassium salt other than potassium nitrate to the denitrated extract to achieve a potassium content approximating that originally present in the unextracted tobacco; and (d) recombining the denitrated potassium containing extract and the fibrous tobacco residue.

2. A method of treating tobacco to reduce the delivery of gas phase components during combustion thereof which comprises:

(a) forming an aqueous extract of tobacco and a separated fibrous tobacco residue and treating the extract to remove potassium nitrate therefrom;

(b) adding a potassium salt other than potassium nitrate to the denitrated extract; and (c) recombining the denitrated potassium containing extract with the fibrous tobacco residue.

3. The method of claim 2 wherein the potassium content of the aqueous extract is determined prior to step (b).

4. The method of claim 2 wherein the tobacco is extracted with a denitrated aqueous solution of tobacco solubles.

5. The method of claim 2 wherein the removal of potassium nitrate in step (a) is effected by means of membrane electrodialysis.

6. The method of claim 2 wherein the tobacco extract is treated to remove potassium nitrate by crystallization and then further denitrated by membrane electrodialysis.

7. The method of claim 2 wherein the removal of potassium nitrate in step (a) is effected by means of a mixed bed of anion-cation exchange resins.

8. The method of claim 2 wherein the potassium salt added to the denitrated extract in step (b) has an anion portion selected from the group consisting of citrate, acetate, phosphate, carbonate, bicarbonate and malate.

9. The method of claim 2 wherein the potassium salt is added after the denitrated extract has been recombined with the fibrous tobacco residue.

* * * * *

UNITED STATES PATENT AND TRADEMARK OFFICE

CERTIFICATE OF CORRECTION

PATENT NO. : 4,589,428

DATED : May 20, 1986

INVENTOR(S) : Gus D. Keritsis

It is certified that error appears in the above-identified patent and that said Letters Patent is hereby corrected as shown below:

Column 9, line 68, after "unextracted" should be inserted -- burley --.

Claim 1, line 7, "methhod" should be -- method --.

Signed and Sealed this

Fourteenth Day of April, 1987

*Attest:*

DONALD J. QUIGG

*Attesting Officer*

*Commissioner of Patents and Trademarks*